US010395794B2

(12) United States Patent
Meyer et al.

(10) Patent No.: US 10,395,794 B2
(45) Date of Patent: Aug. 27, 2019

(54) HIGH VOLTAGE ELECTRIC TRANSMISSION CABLE

(75) Inventors: Michael Meyer, Burgwedel (DE); Daniel Guery, Dour (BE); Michel Martin, Thuin (BE); Sophie Barbeau, Genas (FR); Claus-Friedrich Theune, Pattensen (DE); Corinne Poulard, Orlienas (FR)

(73) Assignee: NEXANS, Courbevoie (FR)

( * ) Notice: Subject to any disclaimer, the term of this patent is extended or adjusted under 35 U.S.C. 154(b) by 317 days.

(21) Appl. No.: 13/144,150

(22) PCT Filed: Feb. 1, 2010

(86) PCT No.: PCT/FR2010/050159

§ 371 (c)(1),
(2), (4) Date: Dec. 7, 2011

(87) PCT Pub. No.: WO2010/089500

PCT Pub. Date: Aug. 12, 2010

(65) Prior Publication Data

US 2012/0090892 A1 Apr. 19, 2012

(30) Foreign Application Priority Data

Feb. 3, 2009 (FR) ..... 09 50672

(51) Int. Cl.
*H01B 5/00* (2006.01)
*H01B 5/10* (2006.01)
(Continued)

(52) U.S. Cl.
CPC ..... *H01B 5/105* (2013.01); *H01B 7/1825* (2013.01); *H01B 7/223* (2013.01)

(58) Field of Classification Search
CPC ..... H01B 5/102
(Continued)

(56) References Cited

U.S. PATENT DOCUMENTS 2,288,094 A * 6/1942 Karmazin ..... 228/145
2,936,258 A * 5/1960 Benton, Jr. ..... H01B 13/22 156/56
(Continued)

FOREIGN PATENT DOCUMENTS

CN 1270698 10/2000
CN 1454386 12/2003
(Continued)

OTHER PUBLICATIONS

International Search Report dated Jun. 24, 2010.
(Continued)

*Primary Examiner* — Chau N Nguyen
(74) *Attorney, Agent, or Firm* — Sofer & Haroun, LLP

(57) ABSTRACT

An electric cable (10) includes at least one composite reinforcement element (1) including one or more reinforcement element(s) at least partially embedded in an organic matrix. A coating (2) surrounds the composite reinforcing element(s) (1). The coating (2) is sealed all around the composite reinforcing element(s) (1). At least one conducting element (3) surrounds the coating (2), where the thickness of the sealed coating (2) does not exceed 3000 μm.

19 Claims, 2 Drawing Sheets

(51) Int. Cl.
*H01B 7/18* (2006.01)
*H01B 7/22* (2006.01)

(58) Field of Classification Search
USPC ..... 174/128.1, 128.2, 109, 108, 126.4
See application file for complete search history.

(56) References Cited

U.S. PATENT DOCUMENTS

| | | | | |
|---|---|---|---|---|
| 3,717,720 | A * | 2/1973 | Snellman | 174/131 A |
| 3,946,348 | A * | 3/1976 | Schleich | H01B 13/0891 174/125.1 |
| 4,360,704 | A * | 11/1982 | Madry | H01B 9/02 174/102 SC |
| 4,399,322 | A * | 8/1983 | Hafner, Jr. | 174/101.5 |
| 4,820,012 | A * | 4/1989 | Asai | 385/101 |
| 5,191,173 | A | 3/1993 | Sizer et al. | |
| 5,711,143 | A | 1/1998 | Munakata et al. | |
| 6,326,551 | B1 * | 12/2001 | Adams | 174/113 C |
| 6,559,285 | B1 | 5/2003 | Xu et al. | |
| 7,179,522 | B2 * | 2/2007 | Hiel | H01B 5/105 174/102 R |
| 8,525,033 | B2 * | 9/2013 | Grether | 174/128.1 |
| 2004/0182597 | A1 | 9/2004 | Smith et al. | |
| 2005/0129942 | A1 * | 6/2005 | Hiel et al. | 428/375 |
| 2008/0233380 | A1 | 9/2008 | Hiel et al. | |

FOREIGN PATENT DOCUMENTS

| | | |
|---|---|---|
| CN | 1898085 | 1/2007 |
| EP | 1821318 | 8/2007 |
| GB | 2262357 | 6/1993 |
| JP | 06103831 | 4/1994 |
| JP | 9022619 | 1/1997 |
| JP | 10321047 | 12/1998 |
| WO | WO 2008/104171 * | 9/2008 |

OTHER PUBLICATIONS

International Search Report.
Japanese Industrial Standard, Virgin Aluminum Ingots for Electrical Purposes; 1-24, Akasaka 4, Minato-ku, Tokyo 107 Japan, Feb. 1, 1968.
Re-examination report dated Aug. 8, 2017.

* cited by examiner

HIGH VOLTAGE ELECTRIC TRANSMISSION CABLE

RELATED APPLICATION

This application is a National Phase application of PCT/FR2010/050159, which in turn claims the benefit of priority from French Patent Application No. 09 50672 filed on Feb. 3, 2009, the entirety of which is incorporated by reference.

BACKGROUND

Field of the Invention

The present invention relates to an electrical cable. It applies typically, but not exclusively, to high-voltage electrical transmission cables or overhead power transport cables, usually called OHL (overhead line) cables. The latest-generation electrical transmission cables typically have a relatively high continuous operating temperature, which may be greater than 90° C. and may reach 200° C. or higher.

DESCRIPTION OF RELATED ART

Document U.S. Pat. No. 6,559,385 describes an electrical transmission cable of this type comprising a central composite strength member comprising, for example, a plurality of carbon fibers embedded in an epoxy-type thermosetting matrix, an aluminum metal tape wound around said composite strength member and a conducting element surrounding said metallic coating.

However, when this electrical transmission cable operates continuously at high temperature, especially at an operating temperature above 90° C., the thermosetting matrix of its composite strength member may undergo thermal oxidation, clue in particular to the oxygen of the air, which induces chemical degradation and consequently an increase in porosity of said matrix. Thus, the mechanical properties of the composite strength member, especially that of the organic matrix of which it is composed, may decrease significantly and lead to fracture of the electrical transmission cable. In addition, said organic matrix is subjected to any type of external agent, other than the oxygen of the air, that may also degrade the composite strength member.

Document EP 1 821 318 describes an electrical cable comprising composite wires surrounded by an aluminum coating, said coating itself being surrounded by conducting elements. This aluminum coating is of the filling type since it penetrates into the interstices between the composite wires. Finally, each composite wire may be surrounded by a heat-resistant protective layer.

OBJECTS AND SUMMARY

However, too great a thickness of the aluminum coating prevents both the weight of the electrical cable, especially when it is of the OHL, type, and the mechanical properties of the cable, especially its flexibility, from being optimized. Furthermore, the aluminum coating is applied with a substantial supply of heat that tends to thermally degrade the composite wires.

The object of the present invention is to alleviate the drawbacks of the prior art.

The subject of the present invention is an electrical cable comprising:

at least one composite strength member comprising one or more reinforcing elements at least partly embedded in an organic matrix;

a coating surrounding said composite strength member or members, said coating being sealed all around the composite strength member or members; and at least one (electrical) conducting element surrounding said coating, said cable being distinguished in that the thickness of the sealed coating is at most 3000 μm.

In other words, the coating of the invention has no joins or openings.

The sealed coating advantageously protects the composite strength member, whatever its nature, from all kinds of attack to which it could be sensitive, such attack coming from external agents surrounding the electrical cable. Thus, the sealed coating, in an operational configuration of the electrical cable, prevents any penetration of said external agents from the outside of said coating into the composite strength member or members.

The external agents may for example be the oxygen in the air. In this case, the sealed coating prevents thermal oxidation of the organic matrix of the composite strength member. The external agents may also be moisture, ozone, pollution or UV radiation, or may stem from coating substances or wire-drawing oil residues during manufacture of the electrical cable, especially when laying the conducting element or elements around the composite strength member or members.

The sealed coating also has the advantage of protecting the composite strength member or members during placement of accessories, such as junction or anchoring points, or when cutting the conducting element of the cable, and also of protecting it from abrasion.

Finally, since the thickness of the sealed coating is only at most 3000 μm, the electrical, cable according to the invention has, on the one hand, a weight optimized for use as an OHL cable and, on the other hand, very good mechanical properties, especially flexibility: the sealed coating of the invention thus does not degrade the flexibility of said electrical cable, which flexibility is provided by the composite strength member or members.

The flexibility of the electrical cable of the invention, especially an OHL cable, makes it possible to prevent the cable being damaged when, on the one hand, it is wound on a drum so as to transport it and when, on the other hand, it passes over pay-out/breaking devices and/or over pulleys when it is being installed between two pylons.

In addition, during manufacture of said cable, the application of the sealed coating is not only greatly facilitated but it also avoids any thermal degradation of the composite strength member or members.

The sealed coating of the invention may advantageously be obtained by heat treatment of a metallic material and/or a polymeric material.

In a first embodiment, the sealed coating includes at least one metallic layer obtained by heat treatment of a metallic material, the heat treatment making it possible to seal the coating.

Advantageously, this sealed "metallic" coating participates in transporting the energy of the electrical cable in operation when it is in direct contact with the conducting element. The current flowing in the latter will therefore be shared between the sealed coating and the conducting element according to their respective electrical resistances.

The expression "at least one metallic layer" is understood to mean a coating comprising one or more layers of a metal or of a metal alloy. When the coating comprises at least one metallic layer and at least one polymeric layer, the coating is called a complex coating.

According to a first embodiment, the metallic layer is obtained by welding along the metallic material in the form of a strip, the weld thus making it possible to seal it.

According to a second embodiment, the metallic layer is obtained by helical welding of the metallic material in the form of a tape, the weld thus making it possible to seal it.

Whether in the first or second embodiment, the welding of the metal strip or of the metal tape may be carried out by techniques well known to those skilled in the art, namely by laser welding or by gas-shielded arc welding beneath, i.e. TIG (tungsten inert gas) welding or MIG (metal inert gas) welding.

According to these two embodiments, the very small thickness of the sealed coating (i.e. at most 3000 μm) may advantageously facilitate the winding of the metallic material around the composite strength member or members prior to welding.

Furthermore, the small amount of energy supplied on the one hand, and the limited area of heating induced by the welding on the other hand, prevent thermal degradation of the composite strength member or members.

These two embodiments are thus more advantageous than a metallic layer obtained by extrusion of a metallic material around the composite strength member or members, especially when the extrusion is of the "filling" type, thus involving direct contact between the extruded material and the composite strength member or members. This is because the extrusion of a metallic material requires very high processing temperatures that may damage said composite members.

According to another feature of the invention, the "metallic" coating, or metallic layer, is annulate or corrugated, so as in particular to obtain better flexibility of said coating. In other words, the sealed metallic coating has parallel or helical undulations on its external surface.

According to one feature of the sealed metallic coating of the invention, the metallic material, is a metal or a metal alloy and may more particularly be chosen from steel, steel alloys, aluminum, aluminum alloys, copper and copper alloys.

According to a second embodiment, the sealed coating includes at least one polymeric layer obtained by heat treatment of a polymeric material, the heat treatment making it possible to seal the coating.

More particularly, the polymeric layer is obtained by softening the polymeric material.

The term "softening" is understood to mean applying a temperature capable of making the polymer material malleable, or a softening temperature, so as to seal it. For example for a crystalline or semicrystalline thermoplastic, the softening temperature is a temperature above the melting point of the polymeric material.

The polymeric material may be chosen from a polyimide, a polytetrafluoroethylene (PTFE), fluorinated ethylene polymer (PEP) and a polyoxymethylene (POM), or a blend thereof.

As an example, an FEP tape may be used for helically surrounding the composite member or members with a nonzero degree of overlap. This FEP tape is then heat-treated by heating it to a temperature of about 250° C., i.e. a temperature above its melting point, so as to seal the tape.

However, the first embodiment is preferred over the second embodiment. This is because a sealed coating of the metallic layer type ensures better sealing and protection than a sealed coating of the polymeric layer type.

In a third embodiment, the sealed coating comprises at least one polymeric layer and at least one metallic layer that are obtained by heat treatment of a polymeric material and of a metallic material respectively. In other words, said sealed coating is a complex coating. The various features described above in the first embodiment and/or in the second embodiment apply here.

According to the invention, the sealed coating surrounding the composite member or members may be in the form of a tube.

The tube is conventionally a hollow cylinder having a thickness that is substantially constant along the tube. The inside diameter of the tube may or may not be identical along the length of said tube.

This tubular form advantageously helps to improve the mechanical strength characteristics of the electrical cable by uniformly distributing the mechanical forces that may be caused by compression of the conducting elements and/or of the sealed coating during installation of the OHL-type electrical cable.

To suspend this type of cable from a pylon, anchoring accessories are necessary. These accessories serve for mechanically connecting the electrical cable to a pylon on which it has to be installed. Likewise, to connect two lengths of electrical cable according to the invention, jointing accessories are used.

These accessories are put into position by being compressed onto the conducting element or elements, onto the sealed coating and/or onto the strength member or members.

Said tube may have an inside diameter equal to or greater than the outside diameter in which the composite strength member or members are inscribed. If this inside diameter is greater than the outside diameter in which the composite strength member or members are inscribed, the tube is in particular a metal tube. Thus, to obtain a metal tube inside diameter substantially identical to said outside diameter, the step of obtaining the metal tube may be followed by a step intended to shrink (or in other words reduce) the inside diameter of the metal tube.

According to one feature of the sealed coating of the invention, the thickness of said coating may be at most 600 μm and preferably at most 300 μm.

When the sealed coating is of the metallic layer type according to the invention, the thickness of said coating may preferably range from 150 μm to 250 μm.

When the sealed coating is of the polymeric layer type according to the invention, the thickness of said coating may preferably range from 150 μm to 600 μm.

Moreover, as regards the organic matrix of the composite strength member, this may be chosen from a thermoplastic matrix and a thermosetting matrix, or a blend thereof. Preferably, the organic matrix is a thermosetting matrix.

As an example, the thermosetting matrix may be chosen from epoxies, vinyl esters, polyimides, polyesters, cyanate esters, phenolics, bismaleimides and polyurethanes, or a blend thereof.

The reinforcing element or elements of the composite strength member may be chosen from fibers (continuous fibers), nanofibers and nanotubes, or a mixture thereof.

To give an example, the continuous fibers may be chosen from carbon, glass, aramid (Kevlar), ceramic, titanium, tungsten, graphite, boron, poly(p-phenyl-2,6-benzobisoxazole) (Zylon), basalt and alumina fibers. The nanofibers may be carbon nanofibers and the nanotubes may be carbon nanotubes.

The reinforcing element, or elements making up the composite member of the invention may be of the same nature or of different nature.

Said reinforcing elements may thus be at least partly incorporated into at least one of the aforementioned organic matrices. The preferred composite strength members are carbon or glass fibers at least partly embedded in a thermosetting matrix of the epoxy, phenolic, bismaleimide or cyanate ester resin type.

The reinforcing element or elements are positioned within a region bounded by the sealed coating that surrounds them. Preferably, said region does not comprise optical fibers. This is because the presence of optical fibers in the composite strength member or members, or in other words in the internal region bounded by the sealed coating, can but dramatically limit the mechanical strength properties of the electrical cable and therefore does not have the required properties for OHL electrical cables. Moreover, optical fibers are very sensitive to the mechanical stresses exerted on them and consequently these mechanical stresses must be limited as far as possible. Such optical fibers cannot therefore be considered as composite strength members of an electrical cable according to the invention even when they are embedded in a polymeric resin.

Of course, in specific cases the electrical cable of the invention may nevertheless comprise one or more optical fibers, these optical fibers then being positioned around the sealed coating.

As regards the electrical conducting element of the invention that surrounds the sealed coating, this may preferably be metallic, especially based on aluminum, that is to say either only made of aluminum or made of an aluminum alloy such as for example an aluminum/zirconium alloy. In particular compared with copper, aluminum or an aluminum alloy has the advantage of having a significantly optimized electrical conductivity/density pair.

The conducting element of the invention may be conventionally an assembly of metal wires (or strands), the cross section of which may be of round or non-round shape, or a combination of the two. When they are not of round shape, the cross section of these wires may for example be of trapezoidal shape or of Z-shape. The various shapes are defined in the IEC 62219 standard.

In one particular embodiment, the electrical cable may also contain an inert gas, such as for example argon, between the sealed coating and the composite strength member or members. This inert gas serves to minimize the amount of oxygen in contact with the composite strength member or members.

In one particular embodiment, the electrical cable may further comprise an electrically insulating layer positioned between the sealed coating and the composite strength member or members. This layer may be a layer of a heat-resistant polymeric material such as, for example, polyetheretherketone (PEEK), and may in particular surround at least one of the composite members, each composite member, or the assembly formed by all the composite members.

This electrically insulating layer advantageously prevents the appearance of DC current between the composite strength member and the sealed coating when the latter is metallic.

It will be preferable to use an electrically insulating layer surrounding the assembly formed by the composite strength member or members, this electrically insulating layer alone being sufficient to prevent the appearance of DC current. Furthermore, the use of this layer surrounding all, the composite strength members advantageously makes it easier for said layer to be implemented, while saving material.

Moreover, the electrical cable of the invention does not necessarily include an adhesive layer positioned between the composite strength member or members and the conducting element.

In one particularly preferred embodiment, the electrical cable of the invention does not include an external layer surrounding the conducting element or elements, which external layer may typically be an electrically insulating layer or a protective jacket.

The conducting element or elements may therefore be considered as the outermost element or elements of the electrical cable of the invention. Therefore, the conducting element or elements are then in direct contact with the external environment thereof (for example the ambient air).

This absence of an external layer around the conducting element or elements has the advantage of guaranteeing that such an electrical cable has the lowest possible installation tension, this installation tension being proportional to the weight of the electrical cable. In other words, it is beneficial to have an OHL electrical cable presenting the lowest possible mechanical load, this mechanical load being exerted by the cable on the two pylons between which it is suspended.

Consequently, the span of the electrical cable between two pylons may be up to 500 m, or even up to 2000 m.

BRIEF DESCRIPTION OF THE DRAWINGS

Other features and advantages of the present invention will become apparent in the light of the following examples with reference to the annotated figures, said examples and figures being given by way of illustration but implying no limitation.

DETAILED DESCRIPTION

For the sake of clarity, only the essential elements for understanding the invention have been shown schematically and have not been drawn to scale.

Figure 1:
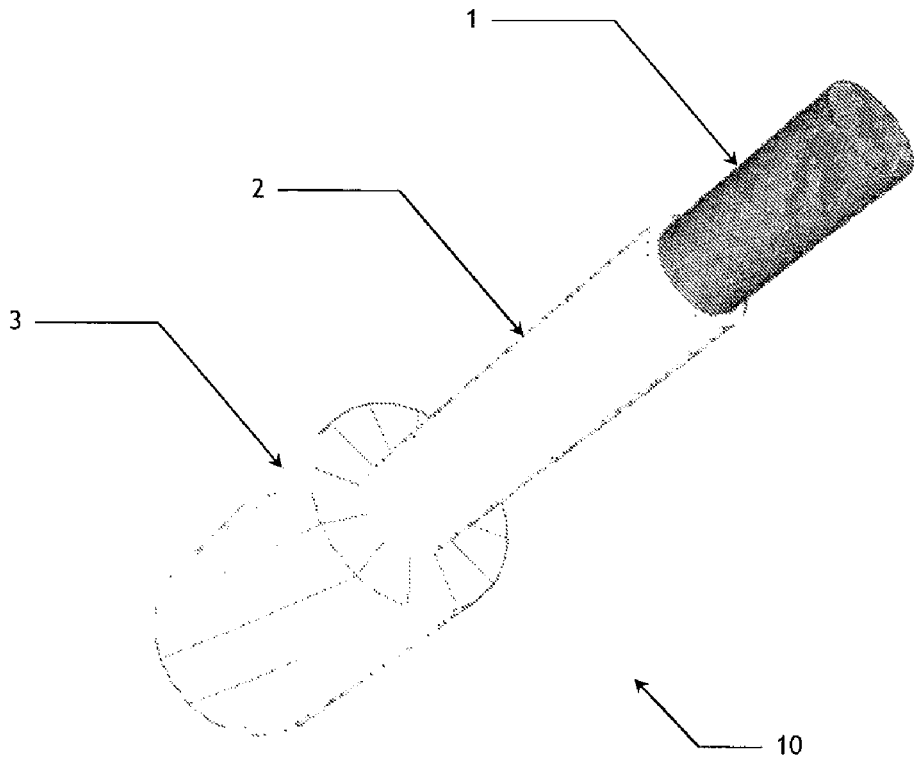
FIG. 1 shows, schematically and in perspective, an electrical cable according to the present invention.

The electrical cable 10 illustrated in FIG. 1 corresponds to a high-voltage electrical transmission cable of the OHL type.

This cable 10 comprises a central composite strength member 1 and, in succession and coaxially around this composite member 1, a metal tube 2 made of aluminum and an electrical conducting element 3. The conducting element 3 is in direct contact with the metal tube 2, the latter being in direct contact with the composite strength member 1.

The composite strength member 1 comprises a plurality of carbon fiber strands embedded in an epoxy thermosetting matrix.

In this example, the conducting element 3 is an assembly of strands made of an aluminum-zirconium alloy, the cross section of each strand of which has a trapezoidal shape, these strands being twisted together. Said conducting element is therefore not in any way sealed from the external environment, and the strands that constitute it also move apart under the heat due to the thermal expansion of the conducting element.

The metal tube 2 may be obtained from a metal strip converted into a tube with a longitudinal slit using a forming tool. The longitudinal slit is then welded, especially using a laser welding device or a gas-shielded arc welding device, after the edges of said strip are brought into contact with each other and held in place in order to be welded. During the welding step, the composite strength member may be on the inside of the metal strip converted into a tube. The diameter of the tube formed is then shrunk (reduction in cross section of the tube) around the composite strength member using techniques well known to those skilled in the art.

As indicated above, other embodiments of this metal tube are possible. The metal tube 2 may be obtained from a metal tape helically wound around the composite strength member or a substitute. The helical slit of this metal tape is then welded, especially using a laser welding device or a gas-shielded arc welding device, after the edges of said tape have been brought into contact with each other and held in place in order to be welded. The abovementioned shrinkage step is also conceivable.

The cable of FIG. 1 does not also include an outer jacket: the conducting element 3 is thus left directly in contact with its external environment (i.e. the ambient air). In the operational configuration of the cable (i.e. once the cable has been suspended between two pylons), the absence of an outer jacket advantageously enables the span of said cable between two pylons to be increased.

Figure 2:
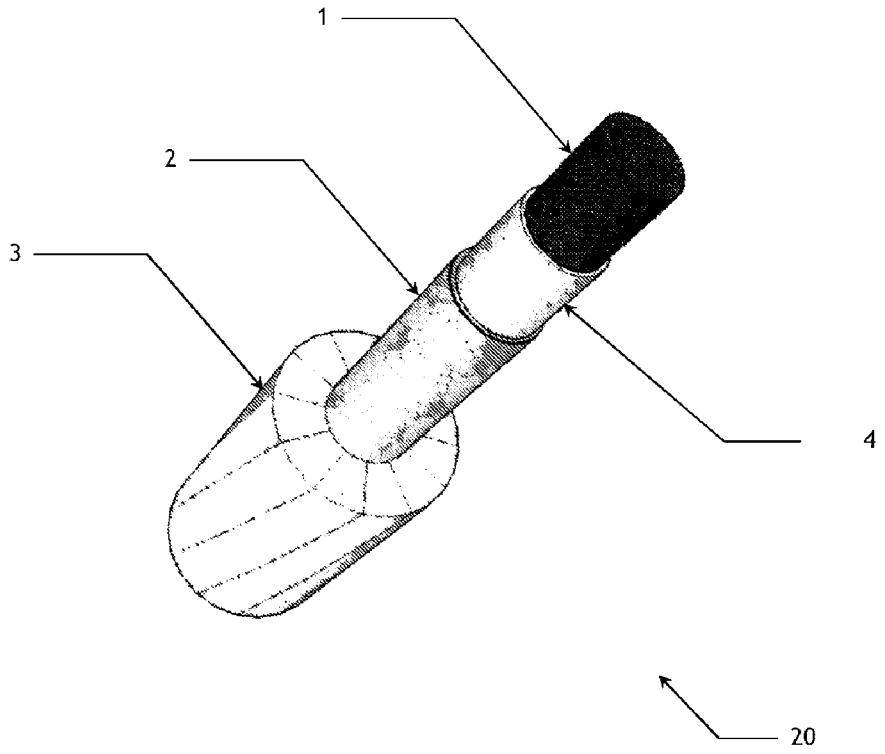
FIG. 2 shows, schematically and in perspective, the electrical cable of FIG. 1 to which an electrically insulating layer according to the invention has been added.

FIG. 2 shows an electrical cable 20 according to the present invention, which is identical to the electrical cable 10 of FIG. 1 except for the fact that the cable 20 further includes a single electrically insulating layer 4 surrounding the composite strength member (i.e. all the composite strength members). This electrically insulating layer 4 is positioned between the metal tube 2 and the composite strength member 1. The cable 20 again does not include an outer jacket around the conducting element 3.

EXAMPLE

To show the advantages of the electrical cable according to the invention, comparative aging and porosity tests were carried out on electrical cable specimens.

A first electrical cable, called "cable I1", was produced as follows. A composite strength member comprising an assembly of carbon fibers embedded in an epoxy resin thermosetting matrix was coated with an electrically insulating layer of PEEK followed by a sealed aluminum layer. The sealed aluminum layer was produced from an aluminum strip welded along its length so as to create a tube around the composite strength member. This aluminum tube was then shrunk around said composite member so as to form said sealed aluminum layer.

A second electrical cable, called "cable C1", corresponded to the cable I1 except that it did not include the sealed aluminum layer.

The aging test was carried out on cables I1 and C1 respectively. This aging test consisted in leaving the cables I1 and C1 to age in ovens at various temperatures. The cable specimens were between about 65 cm and 85 cm in length.

To prevent oxygen from propagating between the sealed aluminum layer and the composite strength member, the two ends of the specimen of cable I1 were covered with metal caps fixed using a Kapton® cape and a Teflon® tape so as to ensure that the ends of said specimen were sealed.

These specimens were then isothermally aged at various temperatures (160, 180, 200 and 220° C.) for variable lengths of time (10, 18, 32, 60, 180 and 600 days).

The aged specimens were weighed so as to monitor the weight loss associated with degradation of the thermosetting matrix. The porosity of the thermosetting matrix was also measured.

Three cable portions about 2 cm in length were cut from the aged specimens one portion of each side of the ends about 2-3 cm from the edge and one portion in the center of the cable specimen.

The cable portions were then potted in a resin, to make the polishing process easier, and then polished so as to obtain a very flat surface.

This surface was then examined under an optical microscope, photographed and analyzed using image analysis software, making it possible to measure the area of the pores relative to the area of the specimen. The degree of porosity of the specimen was thus deduced therefrom.

In view of the results obtained, the electrical cable according to the invention has significantly improved aging properties owing to the presence of the sealed metallic coating.

The invention claimed is:

1. An over head cable comprising:

at least one composite strength member having one or more reinforcing elements at least partly embedded in an organic matrix;

a metal coating surrounding said at least one composite strength member, said metal coating welded directly to itself along its seams so as to be completely sealed tube all around the at least one composite strength member so that the sealed metal coating prevents thermal oxidation of the organic matrix of the at least one composite strength member along the cable; and at least one conducting element surrounding said sealed metal coating, said conducting element having an assembly of metal wires;

wherein the electrical cable further comprises at least one electrically insulating layer positioned between the sealed metal coating and the composite strength member or members, and wherein the thickness of the sealed metal coating is between 150 and 3000 μm so as to be sufficient to protect said composite strength member from environmental degradation and also thin enough to remain flexible enough such that said cable can operate as said over head cable.

2. The cable as claimed in claim 1, wherein the sealed metal coating is at least one metallic layer obtained by heat treatment of a metallic material.

3. The cable as claimed in claim 2, wherein the metallic layer is obtained by welding along the metallic material in the form of a strip.

4. The cable as claimed in claim 2, wherein the metallic layer is obtained by helical welding of the metallic material in the form of a tape.

5. The electrical cable as claimed in claim 2, wherein the metallic layer is annulate.

6. The cable as claimed in claim 2, wherein the metallic material is selected from the group consisting of steel, steel alloys, aluminum, aluminum alloys, copper and copper alloys.

7. The cable as claimed in claim 1, wherein the sealed metal coating is in the form of a tube.

8. The cable as claimed in claim 1, wherein the matrix of the composite strength member is chosen from a thermoplastic matrix and a thermosetting matrix, or a blend thereof.

9. The cable as claimed in claim 1, wherein the reinforcing elements of the composite strength member are selected from the group consisting of fibers, nanofibers and nanotubes, or a mixture thereof.

10. The cable as claimed in claim 1, wherein the electrically insulating layer surrounds the assembly formed by the at least one composite strength member.

11. The cable as claimed in claim 1, wherein the conducting element is based on aluminum.

12. The cable as claimed in claim 1, wherein the electrical cable comprises no external layer surrounding the at least one conducting element.

13. The cable as claimed in claim 1, wherein the welding of the metal coating is carried out by either one of laser welding or gas shielded arc welding.

14. The cable as claimed in claim 1, wherein said cable does not have an adhesive layer positioned between the composite strength member or members and the conducting element.

15. The cable as claimed in claim 1, wherein the conductive element is made of aluminum and zirconium alloy.

16. An over head cable comprising:

at least one composite strength member having one or more reinforcing elements at least partly embedded in an organic matrix;

a metal coating surrounding said at least one composite strength member, said metal coating is a sealed tube welded along all of its seams directly to itself all around the at least one composite strength member so that the coating has no openings along its length; and at least one conducting element surrounding said coating, said conducting element having an assembly of metal wires;

wherein the electrical cable further comprises at least one electrically insulating layer positioned between the sealed metal coating and the composite strength member or members, and wherein the thickness of the sealed coating is between 150-3000 μm so as to be sufficient to protect said composite strength member from environmental degradation and also thin enough to remain flexible enough such that said cable can operate as said over head cable.

17. The cable as claimed in claim 16, wherein the welding of the metal coating is carried out by either one of laser welding or gas shielded arc welding.

18. The cable as claimed in claim 16, wherein said cable does not have an adhesive layer positioned between the composite strength member or members and the conducting element.

19. The cable as claimed in claim 16, wherein the conductive element is made of aluminum and zirconium alloy.

* * * * *